United States Patent [19]

Kusunoki

[11] 4,007,868

[45] Feb. 15, 1977

[54] CONTAINER FOR CARD

[75] Inventor: Yukio Kusunoki, Toyama, Japan

[73] Assignee: Taiyo Package Co. Ltd., Japan

[22] Filed: Sept. 8, 1975

[21] Appl. No.: 611,432

[30] Foreign Application Priority Data

Oct. 8, 1974 Japan ..... 49-121637[U]

[52] U.S. Cl. ..... 229/20; 40/61 R; 206/313; 206/459; 229/23 BT; 229/92.8

[51] Int. Cl.[2] ..... B65D 5/38

[58] Field of Search ..... 229/92.8, 23 BT, 9, 229/11, 19, 20, 17 S; 206/44.12, 44 B, 313, 312, 311, 310, 309, 459; 40/126 A, 124.1, 61 R

[56] References Cited

UNITED STATES PATENTS

| | | | |
|---|---|---|---|
| 922,715 | 5/1909 | Munster | 229/92.8 X |
| 963,886 | 7/1910 | Freeman et al. | 229/92.8 |
| 1,304,773 | 5/1919 | Howell | 229/92.8 X |
| 1,865,608 | 7/1932 | Andrews | 229/11 |
| 2,574,050 | 11/1951 | McCart | 206/312 |
| 2,833,455 | 5/1958 | Planas | 229/20 |
| 3,042,469 | 7/1962 | Lowther | 206/311 X |
| 3,102,635 | 9/1963 | Werwin et al. | 206/313 |
| 3,876,072 | 4/1975 | Phillips | 229/17 S X |

*Primary Examiner*—Stephen P. Garbe
*Attorney, Agent, or Firm*—Larson, Taylor and Hinds

[57] ABSTRACT

A container for greeting card and the like, wherein the card can be taken out from the container when the lid blank of the container is opened and enclosed when the lid blank is closed. The container may have a pattern or a design on both surfaces of the container body and the lid blank, which pattern is variable when the container is opened. Both the container body and the lid blank consist of several paperboard walls forming in combination a whole container.

3 Claims, 7 Drawing Figures

CONTAINER FOR CARD

BACKGROUND OF THE INVENTION

Presentation of cards such as greeting or Christmas card to customers or friends has been prevailing as a traditional elegant custom and it is growing more widely. Such card normally consists of a single paperboard blank or is made in a form of an envelope. However, any new type or design has not developed so far for the card. It has been desirous therefore to provide some pleasant and attractive features to the card which will represent such novelty or attraction for transmitting good will or favor to people.

BRIEF SUMMARY OF THE INVENTION

This invention relates to a container for a card, particularly for a Christmas card, greeting and picture post card. The container is adapted to retain the card therein and the retained card can be taken out from the container when the container is opened and is put into the container when it is closed.

A primary object of the invention is to provide a container which is able to open or close and thereby a card is taken out from or enclosed into the container, the container being arranged so as to arouse an interest or attract attention of the user of the card.

Another object of the invention is to provide a container which is formed with a pattern or design on both surfaces of the container body and the lid blank, which pattern or design is variable as the container is opened or closed so that the user of the card is aroused an interest or attracted attention to the card.

Another object of the invention is to provide a container from which the card can be readily taken out when the lid blank is opened.

A further object of the invention is to provide a container which can contain various types of card, which container may further be enclosed, if desired, in an envelope or wrapping paper convenient for mailing or presenting to persons.

These and other objects of the invention will become clear from the following detailed description of the invention, which by way of example was made with reference to the accompanying drawings. The description is not intended to anyway limit the scope and spirit of the present invention.

DESCRIPTION OF THE INVENTION IN RELATION TO DRAWINGS

Figure 1:
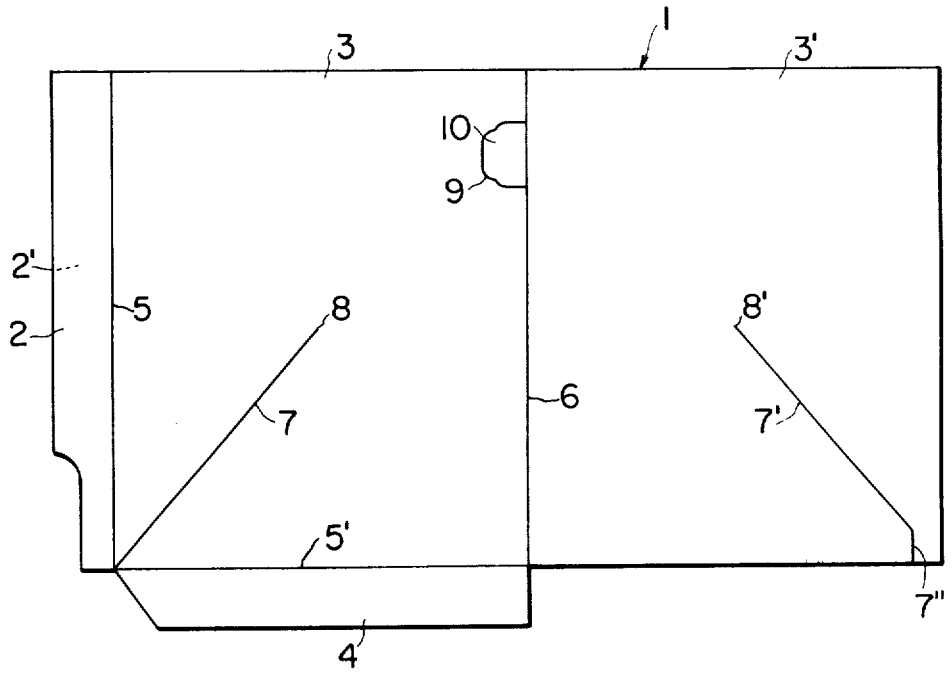
FIG. 1 is an exploded plan view of a container according to the present invention.
Figure 2:
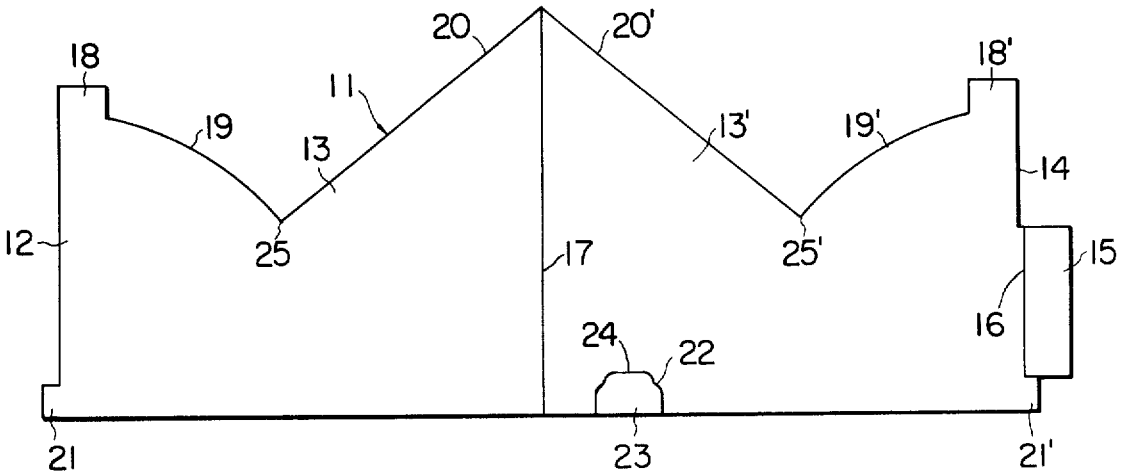
FIG. 2 is also an exploded plan view of a lid blank of the container.

Referring now to the drawings, the container for a card consists in combination of a container body 1 as shown in FIG. 1 and a lid blank 11 as shown in FIG. 2.

In the exploded view of the container, shown in FIG. 1, the container body 1 comprises an end wall 2, first and second inner walls 3, 3′ and a lower wall 4 of the first inner wall 3. The end wall 2 can be folded inwardly along a fold line 5 to right on the figure. The second inner wall 3′ can be folded inwardly along a central fold line 6 to left on the figure and can be connected to back side 2′ of the end wall 2 with adhesive agent.

A lower wall 4 of the first inner wall 3 may be folded upwardly inwardly of the inner wall 3 along a fold line 5′, the backside of the lower wall 4 is connected to the bottom part of second inner wall 3′. In the position shown, the inner walls 3, 3′ respectively include linear slits 7, 7′. In particular, the linear slits 7, 7′ are provided in locations respectively making angles of 45° with the fold lines 5, 5′, such that those slits 7, 7′ are located in the middle of length of diagonal lines extending from an intersecting point of the fold lines 5, 5′. On the inner wall 3′, the linear slit 7′ is provided in a position symmetrically opposite to the corresponding linear slit 7 on the inner wall 3. It will be seen that a lower part of the linear slit 7′ is bent and extended straight downwardly forming a short linear slit 7″. These slits 7, 7′ have terminating points at 8, 8′ generally in the center of the inner walls 3, 3′ respectively. A grip portion 10 may be cut in a preferred form such as in a bowl shape in the upper prt of the inner wall 3 close to the central fold line 6 and cut out by a slit 9, which portion is connected to and projecting from the central fold line 6.

In the exploded view of FIG. 2, which particularly shows the lid blank 11, the lid blank 11 comprises a first end part or area 12, first and second inner parts 13, 13′ contiguous to each other, a second end part or area 14, and an outer end flap 15. The outer end flap 15 as shown can be folded inwardly to left on the figure along a fold line 16. Such part of the outer end flap 15 can be folded inwardly to left on the figure along the fold line 16 and further folded along the central fold line 17 and may be connected by adhesive to the first end wall 12. The end parts 12, 14 are respectively formed with projections 18, 18′, contiguous to which are formed downward curves 19, 19′ adjacent to the inner walls 13, 13′.

These curved edges 19, 19′ terminate at intersecting points 25, 25′ from which extend linear edges 20, 20′ directed upwardly on the inner walls 13, 13′. The linear edges 20, 20′ terminate and meet at the top of the central fold line 17. There are also provided lugs 21, 21′ of a corresponding form projecting from the end walls 12, 14 respectively. A grip portion 23 is cut in a preferred form for example in a bowl shape in the bottom part of the inner wall 13′ defined by curved slit 22 with a fold line 24 to form the grip portion. Numerals 25, 25′ indicate respectively intersecting points of the curved edges 19, 19′ and the linear edges 20, 20′ on the inner walls 13, 13′.

Figure 3:
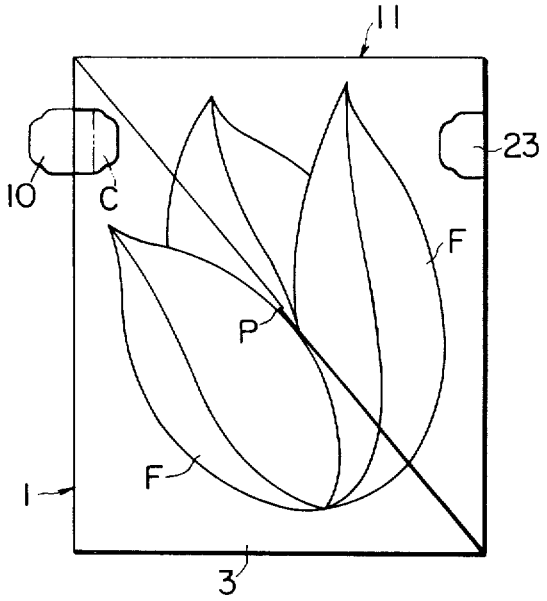
FIG. 3 is a front view of a container of the invention.

The container body 1 of FIG. 1 thus formed may be combined with the lid blank 11 of FIG. 2 in the manner as shown in FIG. 3 having a card C enclosed in the container body 1, such that through the linear slits 7, 7′ the container body 1 may be inserted with the curved edges 19, 19′ of the lid blank 11 respectively into the linear slits 7, 7′ of the container body 1. In this position, the intersecting points 25, 25′ of the curved edges 19, 19′ and the linear edges 20, 20′ may be located at P so as to meet with the terminating points 8, 8′ of the linear slits 7, 7′ of the container body 1.

Figure 5A:
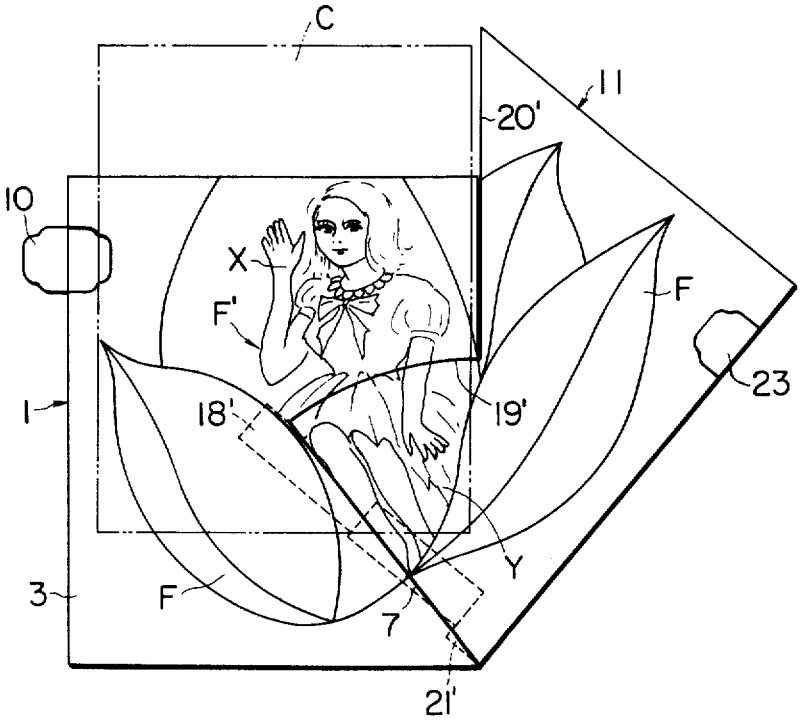
FIG. 5*a* is a front view of a container when it is opened.

Reverting now to FIG. 3, it will be noted that certain pattern or design F may be produced on both outer surfaces of the container body and the lid blank, which may be a pattern or design as for instance of tulip flowers which is shown in a complete form when the container is closed with the lid blank. There is provided a pattern or design in a section X (as shown in FIG. 5*a*) covered under the lid blank, which pattern or design is made different from that produced on the surfaces of the container and the lid blank as firstly mentioned. The lid blank also may have a section Y (as shown in FIG. 5*a*) covered under the container body when the container is closed with the lid blank, which section Y may have a different pattern or design from that on the surfaces when the container is closed with the lid blank. It is thus arranged that the pattern or design in the section X of the container can meet with that in the section Y of the lid blank, that is, the two patterns X, Y may accord or complement each other when the lid blank is taken out and the container is opened. Thus there is produced a different pattern or design from that on the surfaces after the container is opened.

Figure 4:
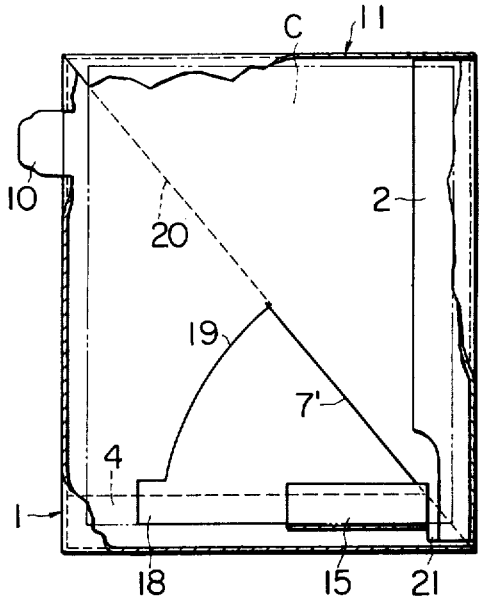
FIG. 4 is a partly sectional view of the container in FIG. 3 showing the inside thereof.

FIG. 4 represents the interior of the container body 1 of FIG. 3, in which the card C is enclosed in the container. In the figure, the card C is mounted in the folding part of the outer end flap 15 of the lid blank 11.

Operation of the container with the card of the present invention in use is now described.

As shown in FIG. 5*a*, when the container with the card is opened by means of the grip portions 10, 23, the curved edges 19, 19′ of the lid blank 11 slide over the terminating points 8, 8′ of the linear slits 7, 7′ of the container body 1 and therefore the lid blank 11 is moved to right on the figure and opened. Then the projections 18, 18′ are stopped and come into engagement with the terminating points 8, 8′, where the lugs 21, 21′ serve as pivotal points to move the lid blank 11 around.

During the operation, the card C is pushed upwardly, while the pattern F of the tulip flowers open into two parts to allow another pattern F′ (sections X, Y) for instance of a princess in the Andersen's fairy tale coming up from between the container body and the lid blank through the opening of the container.

Figure 5B:
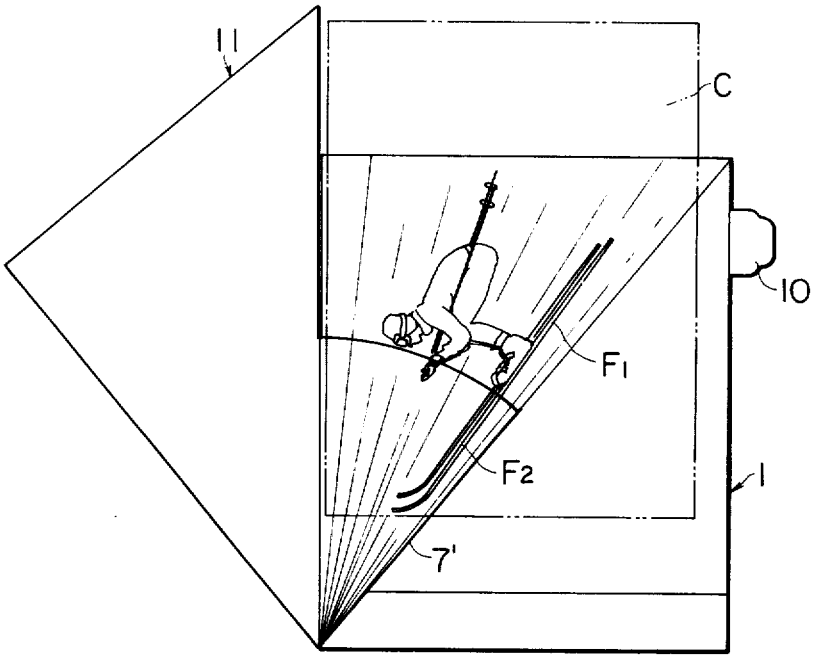
FIG. 5*b* is a view showing a back side of a container when it is opened.
Figure 6:
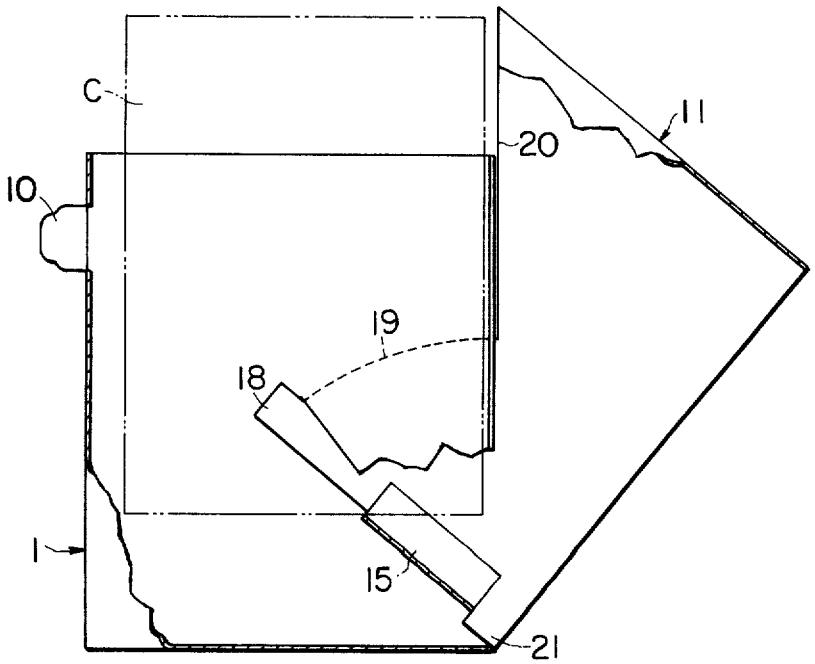
FIG. 6 is a partly sectional view of FIG. 5*a*.

For another embodiment, FIG. 5*b* shows a back side of FIG. 5*a*, which apart from the previous embodiment, represents a design showing a picture of a skiier running on the snowfield. In the embodiment, the pattern $F_1$ is shown in the upper half of the container body 1 and the pattern $F_2$ is in the lower half of the lid blank 11. Since the lid blank 11 is opened as shown, those patterns $F_1$ and $F_2$ are combined into a complete picture and thus, taken together, can provide a representation of the action of a skiier.

What I claim is:

1. A container for card which comprises a container body and a lid in combination, said container body comprising an end wall, first and second inner walls and a bottom flap of the first inner wall, said end wall being folded inwardly along a fold line, the second inner wall being folded inwardly along a central fold line and being connected to a back side of said end wall, and said first and second inner walls each being provided with a linear slit, each said slit extending obliquely from a corner in a lower part of the inner wall and being of a length approximately one half that of a diagonal line drawn from that corner, said lid comprising a first free end, first and second inner walls contiguous to each other, a second free end and an outer end flap, each of said inner walls comprising a projection and a lug at spaced portions thereof adjacent to the associated free end, the outer end flap being folded inwardly along a fold line and being connected by adhesive to an end portion of the first inner wall, said each inner wall being folded along a central fold line and having a projection, a curved edge and a linear edge meeting with a corresponding linear edge at the top of the central fold line, said container body and said lid being combined in use with each curved edge of the lid being inserted into each linear slit of the container body, such that each curved edge of the lid may slide over a terminating point of the linear slit so that, when the lid is opened the associated projection is rotated with the lug functioning as a fulcrum and so that during said rotation said projection engages the terminating point so as to prevent further rotation.

2. A container for card as defined in claim 1, wherein the container body and the lid in a closed position are provided with a pattern or design on the surfaces of both container body and lid, said pattern or design being variable upon opening of the container body.

3. A container for card as defined in claim 1, which container is capable of containing various kinds of cards.

* * * * *